US006442874B1

(12) United States Patent
Long

(10) Patent No.: US 6,442,874 B1
(45) Date of Patent: Sep. 3, 2002

(54) ATHLETIC SHOE WITH AN ADJUSTABLE SIZING SYSTEM

(75) Inventor: Bradley S. Long, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 09/640,371

(22) Filed: Aug. 17, 2000

(51) Int. Cl.[7] ..... A43B 3/26

(52) U.S. Cl. ..... 36/97; 36/112; 36/71; 36/81

(58) Field of Search ..... 36/97, 112, 71, 36/81, 105, 132, 136, 72 R, 1.5, 2 R, 72 B, 58.5, 58.6

(56) References Cited

U.S. PATENT DOCUMENTS 354,360 A * 12/1886 Taber
1,515,086 A * 11/1924 Baluta
1,926,818 A * 9/1933 Ratcliff
2,054,958 A * 9/1936 Tousley
3,431,658 A * 3/1969 Finn
3,618,232 A * 11/1971 Shnuriwsky
4,503,628 A * 3/1985 Mancinelli et al.
4,642,916 A * 2/1987 Collins
5,090,140 A * 2/1992 Sessa
5,109,614 A * 5/1992 Curry
5,733,647 A * 3/1998 Moore, III et al.
6,286,232 B1 * 9/2001 Snyder et al.

* cited by examiner

*Primary Examiner*—Ted Kavanaugh
(74) *Attorney, Agent, or Firm*—Banner & Witcoff, Ltd.

(57) ABSTRACT

An article of footwear that includes a sizing system to allow the shoe size to be adjustable by the wearer. The article of footwear in the form of a shoe includes a sole, an upper extending from the sole, and a sizing member located within the upper, in which the sizing member is attached to the upper at the rear end of the athletic shoe. The sizing member includes an inner core, a separation feature, a fastening system, and locking feature. The inner core is substantially enclosed in a lining and the separation feature includes a plurality of perforations at the top of the sizing member. The sizing member enables a user to adjust the effective length of the shoe. The article of footwear may also include separable sockliner layers. This enables a user to adjust the effective height of the shoe. If an upper sockliner layer wraps upwardly at its sides and/or if the sizing member wraps substantially around the heel, removal of the upper sockliner layer 51 and/or the sizing element enables a user to adjust the effective width of the shoe. Also a method of adjusting the size of the article of footwear is disclosed.

32 Claims, 10 Drawing Sheets

ATHLETIC SHOE WITH AN ADJUSTABLE SIZING SYSTEM

FIELD OF INVENTION

The present invention generally relates to shoes, in particular, to athletic shoes that include an adjustable sizing system.

BACKGROUND

Numerous consumers purchase shoes and other footwear for use in athletic activities such as running, cross training, soccer, football, baseball, tennis, walking, and the like. In recent years, sports directed to children have been very popular. In order for these children to compete effectively and to reduce immediate and future podiatric problems, it is essential that they wear shoes that are sized properly.

As children develop, consumers purchase numerous pairs of athletic shoes of increasing sizes to maintain the pace of the child's growth. In general, the feet of children grow quickly during the younger years and decelerate as the children reach maturity. Many parents have purchased shoes for their children only to see that the child has grown out of the shoes before the shoes have been barely worn. This problem is magnified for certain shoes made for specific seasonal sports where the wearable season is short. To avoid the cost of replacing shoes on a frequent basis, some parents might purchase shoes in larger sizes in an effort to preempt the growth of the feet. Alternatively or additionally, some parents may have their children wear the shoes even when the child has slightly outgrown them. Neither of these practices are desired because the shoes will not likely fit properly for the wearer. Improper or poorly fitting footwear may effect the athletic performance of the child or could aggravate medical problems associated with the foot.

In general, most children's feet grow approximately one full shoe size in a year, or one-half shoe size about every four months to six months. Consequently, the shoes need to be purchased frequently to accommodate the feet of the child. The feet of children may grow about one-third inch or more in length within a year. For families on limited budgets, the additional costs may create problems or cause the parents to forego the athletic activity. Some parents may forego purchasing new shoes and keep the poor-fitting shoes on the children. Unfortunately, this unintended problem may lead to effecting the proper growth and development of the feet of the children or could for cause future medical problems. Thus, it is advantageous to extend the life of footwear to reduce the number of frequent purchases. Also it is advantageous to provide footwear that fits properly for the wearer for as long as possible.

The American standard sizing system has various size designations such as 6, 6½, and 7. Other standard world wide footwear sizing systems such as the English, European, and metric use similar type sizing arrangements. Under the American standard designation system, 6 and 6½, and 6½ and 7 are considered to be adjacent sizes in the sizing system. These adjacent sizes are also considered to have half-size length differentials while 6 and 7 would be considered as having a full size length differential. The size ranges and designation vary between women, men, girl, boy, and infant footwear. In general, footwear manufacturers provide the shoes in most sizes for each half size length differentials to accommodate the consumer's demand for shoes that properly conform to the feet of the wearer. This is a special consideration when supplying shoes to children. Manufacturing shoes for each half size can be expensive causing manufacturers to incur additional tooling and setup costs. The additional cost increases through the entire production, distribution, and retail supply channels. In addition, the intermediate sized shoes may increase inventory and carrying costs of the distributor and thus, may also increase the cost to the ultimate consumer who uses the shoes. Thus, it would be advantageous to reduce the number of differing sized shoes in a product line to reduce the cost of shoes, for the consumer and the manufacturer, if it could be accomplished without sacrificing the consumer's demand for properly fitting shoes.

SUMMARY OF THE INVENTION

In view of the foregoing, the present invention is directed to an article of footwear that includes a system to allow the shoe size to be adjustable by the wearer. The present invention is an article of footwear in the form of a shoe that includes a sole, an upper extending from the sole. The upper has a front and rear portions, and a foot opening at the rear portion. The foot opening is positioned to receive a foot when the shoe is worn. There is also a sizing member selectively positionable between a first position within the foot opening and a second position outside of the foot opening. In one aspect of the present invention, the sizing member has a preformed separation line to allow the sizing member to be detachable from the upper.

The sizing member provides the ability to extend the useful life of an athletic shoe for a particular wearer an athletic shoe beyond a conventional intermediate sized shoe. According to one aspect of the present invention, the sizing member includes an inner core, a preformed separation line, a fastening system, and a locking feature. The inner core is substantially enclosed between a front cover and a rear cover and the separation line embodies a plurality of perforations at the top of the sizing member. The fastening system preferably includes mating features, such as hooks and loops, to secure the sizing member to the upper by a mechanical connection. The locking feature includes a flap that secures the sizing member between a sockliner and the sole when the shoe is worn. The present invention further includes a sockliner of multilayer construction in which the layers are individually separable with respect to each other. The sockliner includes a base and a plurality of removable layers to adjust the size of the athletic shoe in conjunction with the sizing member.

Another aspect of the present invention is a method of adjusting the effective length of the article of footwear. The sizing member receives the foot of the wearer to provide an appropriate fit until the foot outgrows the footwear. The article of footwear includes a sole, an upper extending from the sole and an foot opening for receiving the foot of a wearer in which a sizing member is positioned within the foot opening and attached to the upper. The method has the following the steps where the user wears the footwear having a first effective length in which the sizing member contacts of a rear panel of the upper. Next, the user creates a second effective length by removing the sizing member from the foot opening. Finally, the user wears the footwear having the second effective length. The second effective length is greater than the first effective length.

Another object of the present invention is to reduce the life cycle cost to consumers for purchasing shoes.

These and other objects, features and advantages of the present invention will be apparent upon consideration of the following detailed description thereof, presented in connection with the following drawings in which like reference numerals identifying the elements throughout.

DETAILED DESCRIPTION OF THE PREFERRED EMBODIMENT

Figure 1:
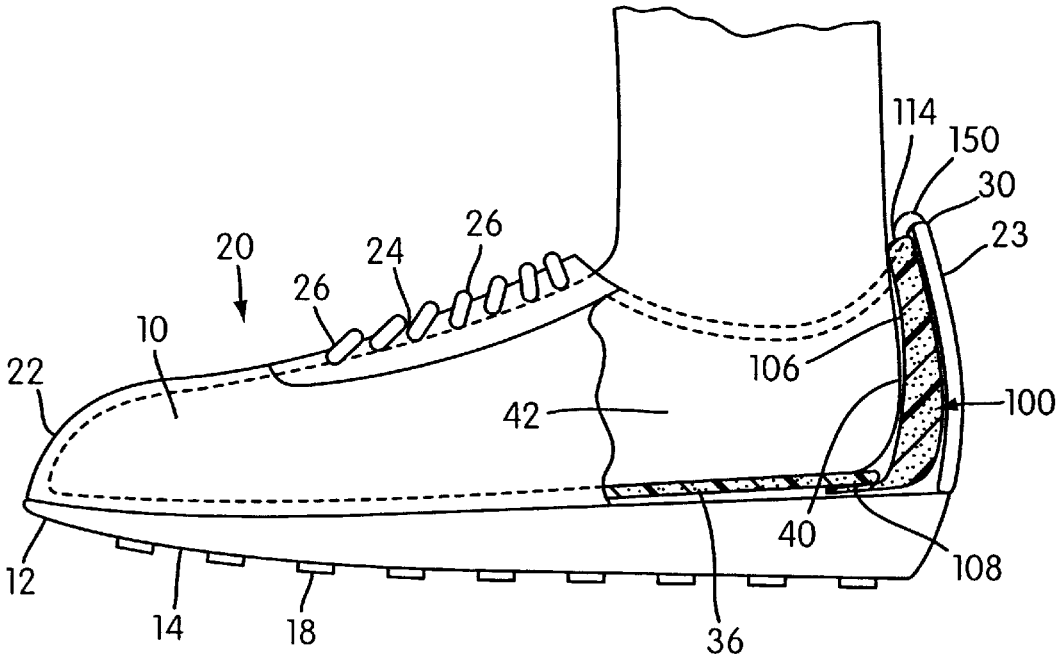
FIG. 1 is a partially broken away side view of an article of footwear and a sizing member according to the present invention.

FIGS. 1–13 depict an article of footwear according to the present invention in the form of an athletic shoe designated generally by reference numeral 20. The shoe 20 includes an upper 10 secured to a sole 12. The sole 12 preferably includes an outer sole 14 and a midsole 16. The shoe 20 may optionally be cleated 18 depending on its intended use.

The upper 10 includes a forefoot section 22, a heel section 28, an ankle collar 30, and an insole, also known as a sockliner 36. The upper 10 is fastened or secured around its bottom periphery to the sole 12 by any desirable method such as, stitching or adhesive bonding. The upper 10 includes any desirable fastening system for securing the shoe 20 to the foot 42 of the wearer. For example, the fastening system may include a lace 26 and plurality of eyelets 24 or lace holding elements. The forefoot section 22 extends over the toes of the wearer of the shoe 20. The upper 10 includes a foot opening 31 positioned between the quarter section 38 and the heel section 28 that receives the foot 42 of the wearer.

The heel section 28 of the upper 10 substantially envelops the heel 40 of the wearer and is located at the rear end of the upper 10. The heel section 28 also includes an internal heel portion 34 that receives the foot 42 and the heel 40 of the wearer. The periphery of the internal heel portion 34 comprises the area at the rear end of the shoe 20 around the heel 40 connecting the medial side and lateral side of the shoe 20. An inner surface 33 of the internal heel portion 34 is located adjacent to the foot 42. The inner surface 33 is part of the upper 10 and preferably extends from the sole 12 to the collar 32. The ankle collar 30 is located at the upper end of the heel section 28 around the foot opening 31.

Figure 4:
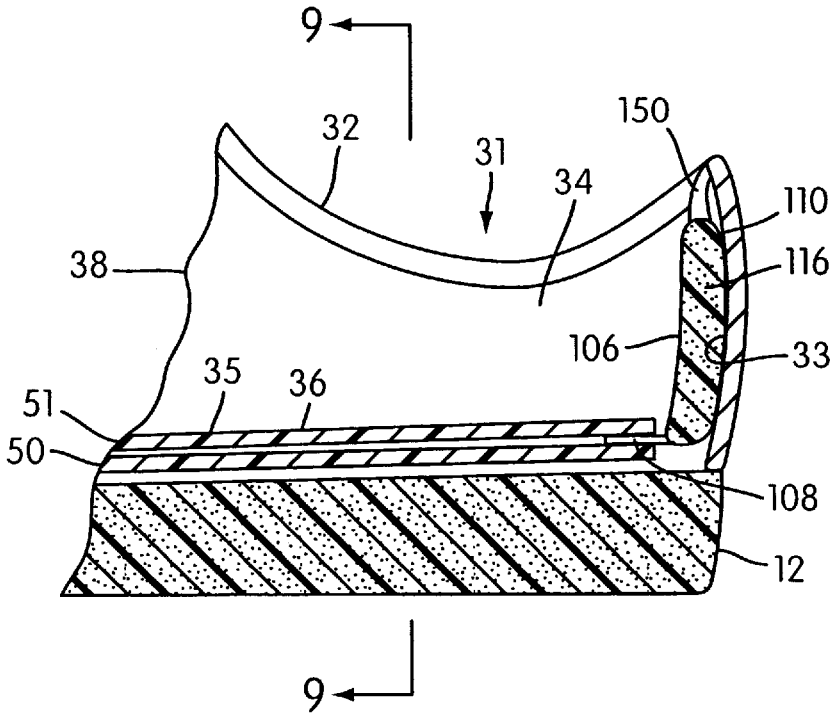
FIG. 4 is a sectional view of a quarter portion of an athletic shoe in accordance with the present invention.

The sockliner 36 is disposed inside of the shoe 20 and is preferably positioned between the foot 42 of the wearer and the sole 12. In addition, the sockliner 36 further includes an upper surface defining a footbed 35, which is the portion of the shoe 20 that is in contact with the bottom of the foot 42 of the wearer. The sockliner 36 provides additional cushioning, shock absorption, and assists in sizing the shoe 20. The sockliner 36 preferably consist of a plurality of separable layered elements 50 and 51 as shown in FIG. 4. Alternatively, sockliner 36 may consist as a single element as shown in FIG. 1.

Figure 5:
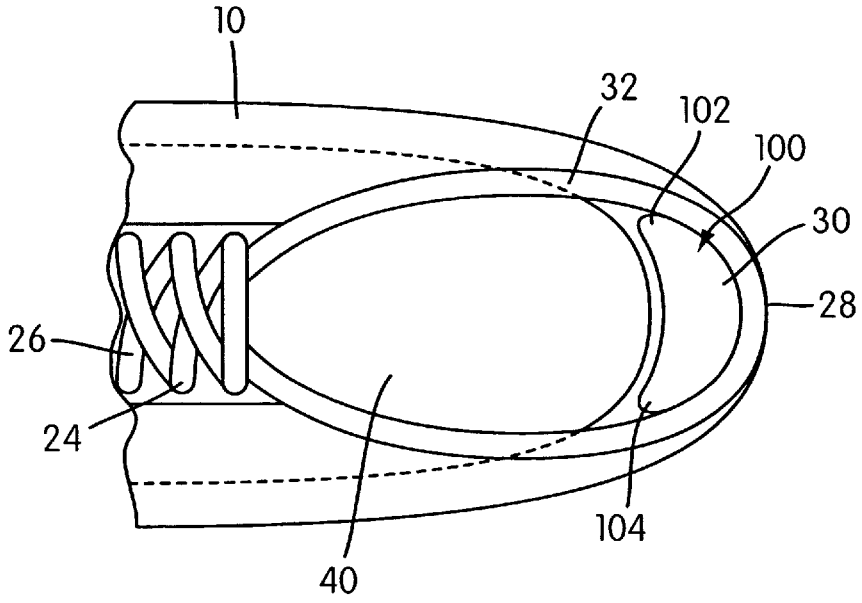
FIG. 5 is a top plan view of the internal heel section of the athletic shoe showing a heel of a wearer and the sizing member.
Figure 6:
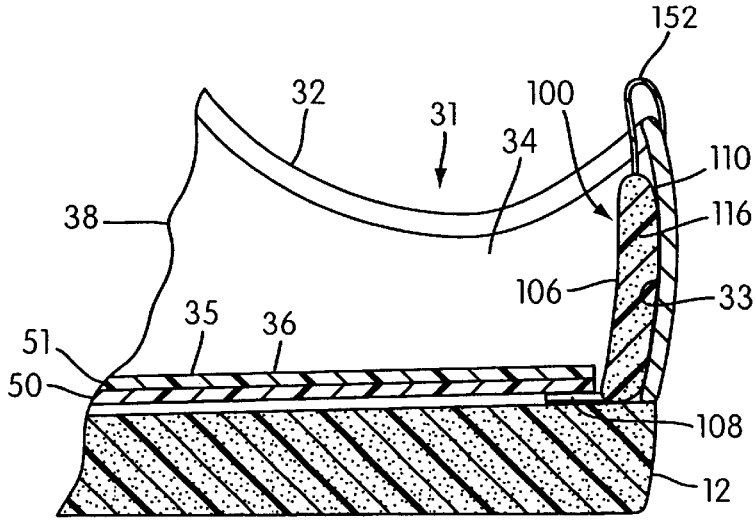
FIG. 6 is a side elevational view of the athletic shoe similar to FIG. 4 showing an elongated strap connecting between the sizing member 100 and the upper 10.

The shoe 20 further includes an adjustable sizing system that can provide alternative effective sizing distances for the length, width and/or girth (height) of the shoe 20. Referring to FIGS. 1, 4 and 5, the shoe 20 further includes a sizing member 100 disposed to engage a foot 42 of a wearer when worn. As explained in further detail hereinafter, the sizing member 100 extends the useful life of the shoe 20 by allowing the wearer to adjust an effective length of the shoe 20. The sizing member 100 is movably attached to the upper 10 for eventual removal from the shoe 20 or for alternate positioning on the shoe 20. The sizing member 100 is preferably disposed inside of the opening 31 of the upper 10 when in an "in use" position. More specifically, in a preferred embodiment, the sizing member 100 preferably engages the heel 40 of the wearer to provide a comfortable fit. In this position, the sizing member 100 performs the function of a spacer to substantially space the rear of the foot 42 of the wearer from the heel section 28 and to shorten the effective length of the shoe 20. Thus, when in an "in use" position, sizing member 100 acts to increase the thickness of the rear wall of the shoe 20, which in turn, decreases the effective length of the shoe 20.

Figure 2:
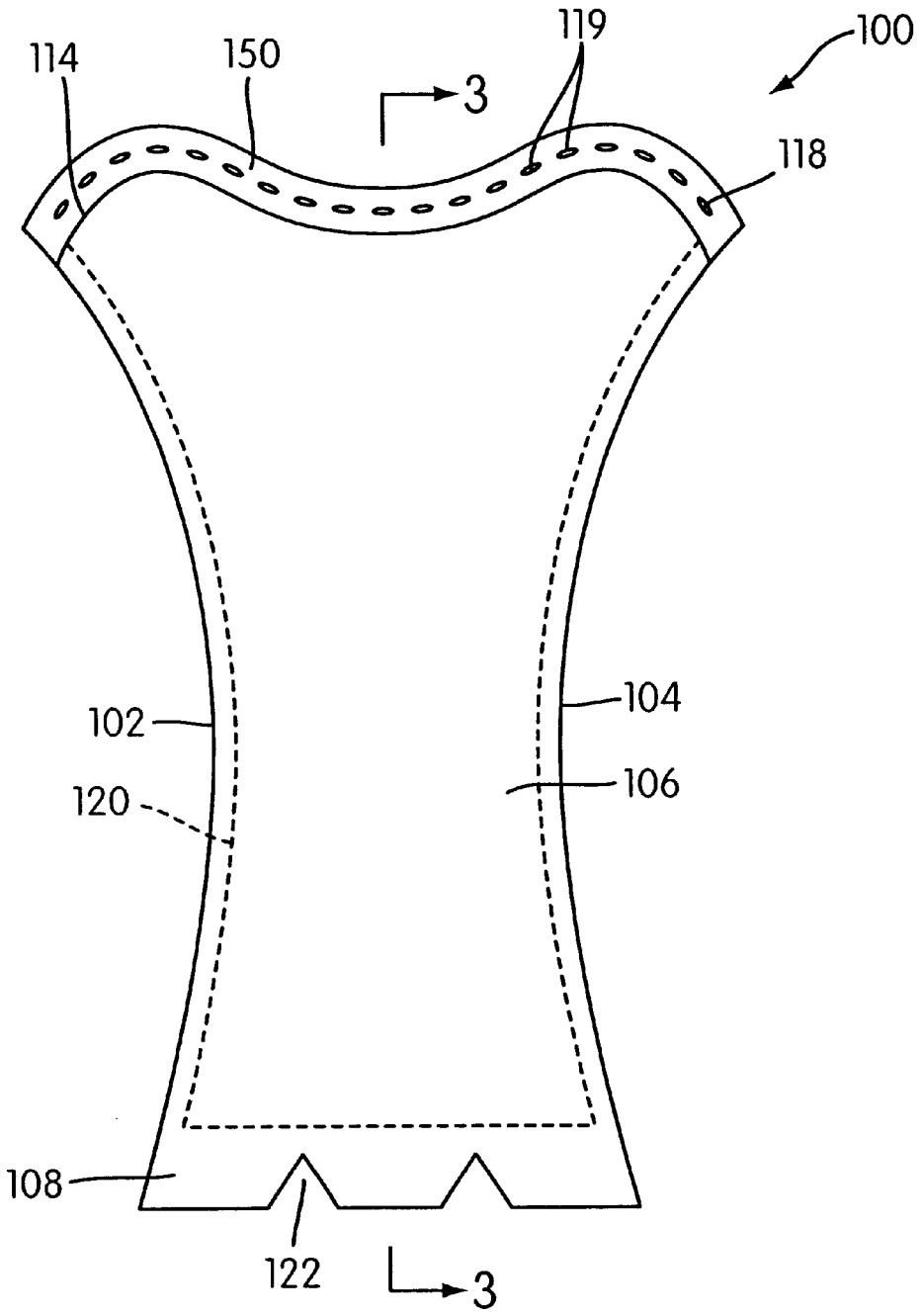
FIG. 2 is a front view of the sizing member.
Figure 3:
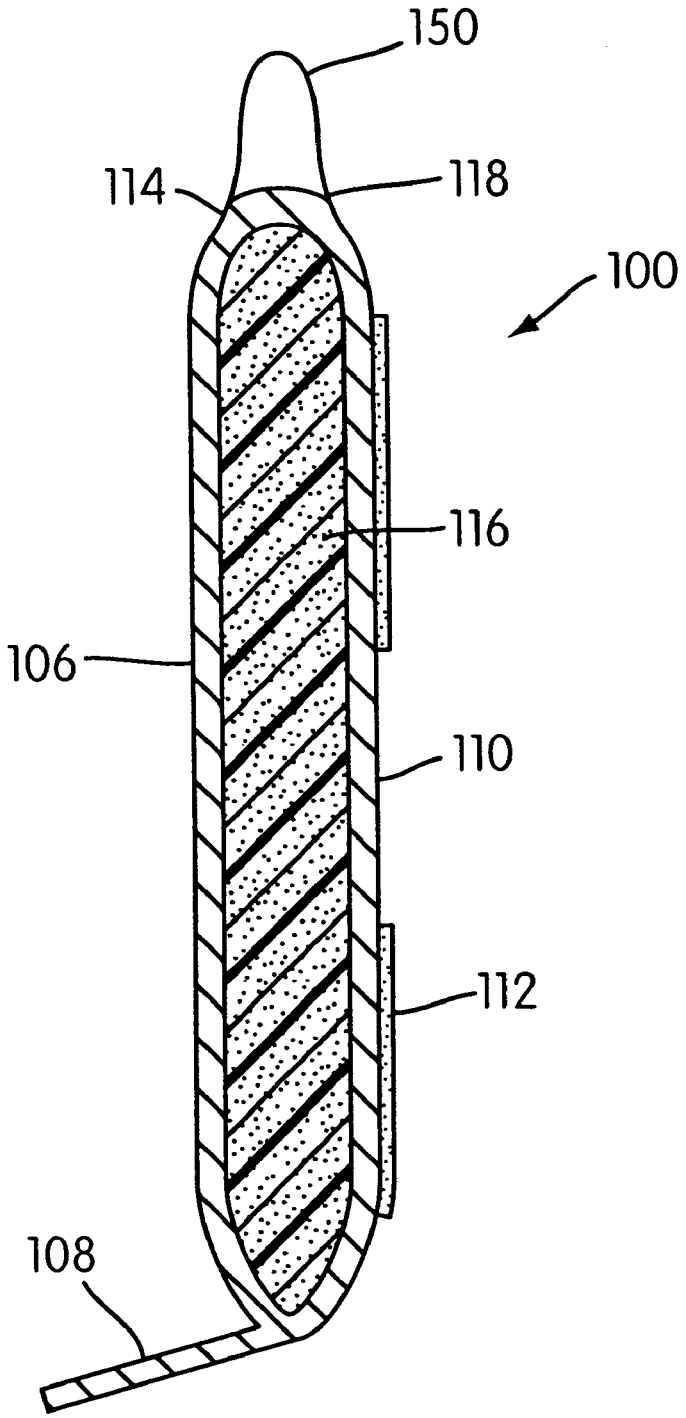
FIG. 3 is a cross sectional view taken along line 3—3 of FIG. 2.

Referring to FIGS. 2 and 3, the sizing member 100 includes a lateral side 102 and a medial side 104. The designations of medial and lateral correspond to the side of the shoe that the side of the sizing member 100 is disposed when it is in an in-use position. Both the lateral 102 and medial 104 sides preferably have a concave curvilinear periphery from top to bottom. This concave curvilinear structure advantageously allows the sizing member 100 to more substantially conform to the inner surface 33 of the internal heel section 34 without bunching, and thereby providing an improved fit for the wearer. Referring to FIG. 3, the sizing member 100 preferably includes padding or cushioning 116 having sufficient thickness to reduce the effective length of shoe 20 by the difference in effective length between two shoe sizes. The difference in effective length may be a half-size or another variation. In a preferred arrangement, the difference in effective length provided by the sizing member 100 corresponds to adjacent shoe sizes in a standard shoe sizing system.

The sizing member 100 includes a compressible center 116 having a desirable thickness. In one arrangement, the sizing member 100 includes an front covering 106, a center core 116, and a rear covering 110. The front covering 106 includes an outer surface that contacts and engages the heel 40 of the wearer. The center core 116 is substantially encased and disposed between the front cover 106 and rear cover 110. It is preferably enclosed such that the compressible center core 116 is in an air tight structure. This protects the core 116 from moisture and other environmental factors that can potentially cause damage to the core 116. The front and rear coverings 106 and 110 may be attached together by suitable arrangement such as by stitching 120 disposed at or adjacent their periphery.

The rear covering 110 preferably includes at least a portion of a fastening system 112 on its outer surface. The fastening system 112 reliably couples the sizing member 100 to the surface 33 in the internal heel section 34 of the upper 10 when the sizing member 100 is in an "in use" position. The fastening system 112 also allows the sizing member 100 to be separable or releasable from the inner surface 33, when desired by the wearer. This is accomplished by placing a releasing force on the sizing member 100 of sufficient magnitude to break an adhesive or a mechanical bond. The fastening system 112 is used as an aid to prevent movement or shifting of the sizing member 100 when the shoe is worn by the wearer.

In one preferred arrangement the fastening system 112 preferably includes a mechanical locking system, for example a hook and loop closure system that may include strips of interlocking materials where one strip would include hooks and the other would include loops. Suitable systems are commercially available such as VELCRO®. If desired, the fastening system 112 may include hooks on the outside of the rear covering 110. A woven or other similar material having interstices between its fibers is provided on the inside facing surface 33 of the heel section 34. In effect, the interstices between the fibers of the material act as loops and lockingly receive the hooks on the rear cover 110. This provides a holding force between the sizing element 100 and the heel section 34 and prevents the sizing member 100 from shifting in the shoe 20 when worn. Another alternative for the fastening system is the use of a tacky releasable adhesive.

If desired, the sizing member 100 may be configured to partially wrap around the heel 42 of the wearer to provide an effective width modification in the rear foot region. With respect to length modification, the effective length of the shoe 20 is reduced when the sizing member 100 is extended into the internal heel section 34. Also the width at the internal heel section 34 is modified to substantially conform to the heel 40 of the wearer. In addition, the center core 116 provides additional volume to modify the internal heel section 34 to absorb unneeded space until the foot 42 of the wearer grows beyond the effective length of the shoe 20 that includes the sizing member 100.

As previously described, the sizing member 100 is preferably coupled to the upper 10 for eventual removal from the shoe 20 or for alternate positioning on the shoe 20. In one preferred arrangement, the sizing member 100 includes a top portion 114 that is attached or coupled to or adjacent to the ankle collar 30 of the heel section 28. This coupling is preferable accomplished by a strap or an extension of the material on the sizing element 100. In the arrangement depicted in FIGS. 1–4, the topportion 114 includes a strip of material 150 that is attached, by sewing or other desired technique to the inside, top, or outside of the ankle collar 30, or adjacent to the ankle collar 30. In the arrangement shown in FIG. 6, a flaccid strap 152 is attached at one end to the top portion of the sizing member 100 and to the other end to the upper, preferably extending over the ankle collar 30. Alternatively, the top portion 114 of the sizing member 100 may be attached directly to the ankle collar 30.

The strip of material 150, strap 152, or other arrangement may include a preformed separation line 118 to facilitate removal of the sizing member 100 from the shoe 20. One function of the separation line 118 is to allow the wearer to manually remove, detach or breakaway the sizing member 100 from the upper 10, when the shoe 20 becomes tightly fitting without the need for a cutting tool. In one embodiment, the separation line 118 includes a relatively narrow portion having a substantially lower tensile strength or lower breaking strength than the balance of the top portion 114. The narrow portion may have a lower tensile or breaking strength than the material of the ankle collar 30 or collar 32. For example, the separation line 118 may be formed of a different material having a substantially lower tensile strength than that of the top portion 114. In one preferred arrangement, the separation line 118 includes a material deformed by a series of spaced prescored perforations 119, or an opposing "V" structure, or a grooved depression. The deformed structure will generally lower the breaking strength along the separation line 118 relative to adjacent undeformed material. The sizing member 100 may be removed by a tearing or cutting operation in which the top portion 114 becomes separated from the upper 10 at the separation line 118. These operations leaves a desirable substantially smooth edge on the ankle collar 30, but member 100 need not include a smooth line preformed line 118. In the case of spaced perforations 119 embodying the separation line 118, the sizing member 100 preferably separates at the perforations 119. For example, the separation line 118 may be a "V" or curved shape such that when the sizing member 100 is removed additional material is retained on the ankle collar 30. If desired, this breakaway feature need not be used and a cutting tool, such as a scissors, may be used to separate the sizing member 100 from the upper 10.

Figure 12:
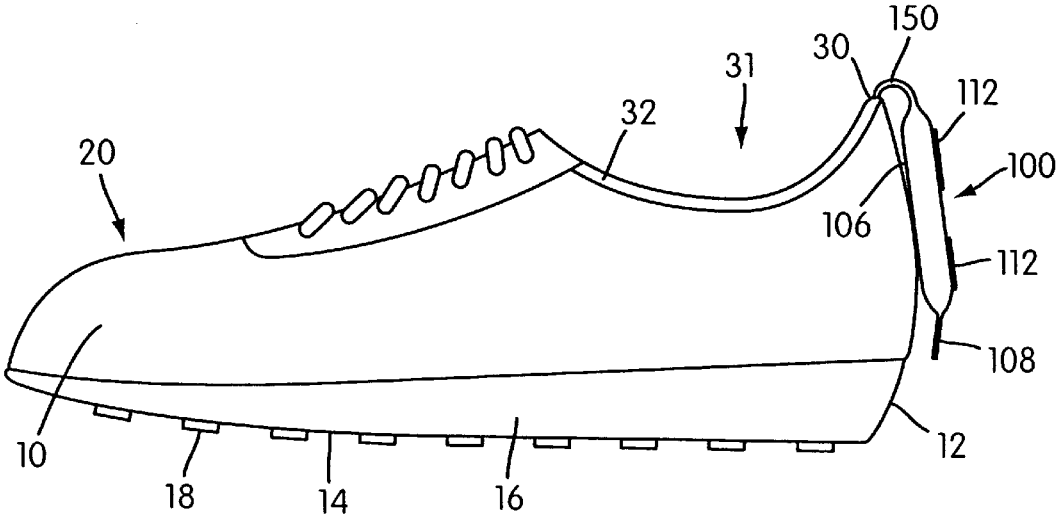
FIG. 12 is a side elevational view of the athletic shoe with the sizing member in a third position outside of the upper.

Alternatively, the strip of material 150 or strap 152 may be used to assist the alternate positioning of the sizing member 100 on the outside of the upper 10. In such an arrangement, as shown in FIG. 12, the sizing member 100 may be folded due to its strip of material 150 or strap 152 to place the sizing member 100 on the outer surface of the heel section 28 of upper 10. Any desirable attachment technique can be used between the/outside of the upper 10 and the sizing member 100 to prevent the sizing member 100 from moving while the shoe 20 is being worn. This permits the shoe 20 to be retain it multi-sizing capability if the shoe 20 is given to another person after modification for the larger size. This function also allows the wearer, if desired, to place the member 100 outside of the shoe 20 for shipping or other purposes.

To further prevent the sizing member 100 from moving within the shoe 20, the sizing member 100 may be provided with an extension flap 108. The flap 108 is preferably a relatively thin member that extends substantially horizontal and is perpendicular from the outer lining 106 when the sizing member 100 is in use. In one preferred embodiment, the flap 108 includes a plurality of notches 122. The plurality of notches 122 may be in the form of a "V", but other shapes may be used. The notches 122 permit the flap position 108 to lie substantially horizontal relative to the sockliner 36 or the like without bunching.

The flap 108 of the sizing member 100 has a number of connection arrangements. When the sizing member 100 is positioned within the internal heel section 34 of the upper 10, the flap 108 is disposed to be generally horizontal and below the foot 42 of the wearer. In one arrangement, the flap portion 108 may be disposed and secured between the bottom surface of the sockliner 36 and the sole 12. In another preferred arrangement, the flap portion 108 may be secured on the top of the sockliner 36 to form part of the footbed 35. In yet another preferred arrangement, with separable sockliner layers 50 and 51, the flap 108 may be disposed between the layers 50 and 51 of the sockliner 36. When the sizing member 100 is in use and the shoe 20 is being worn, the flap 100 is preferably horizontally disposed and will be below the foot 42 of the wearer. The downward pressure of the foot 42 when the shoe 20 is worn substantially locks or anchors the flap 108 into place and in turn further secures the sizing member 100 and prevents its movement within the shoe 20. In another arrangement, not shown, the flap portion 108 removably or fixedly attached to the upper or lower surface of the upper layer 51 of the sockliner 36. By this arrangement, removal of the sizing member 100 from the foot opening 31 will also cause the separation of the upper layer 51 from the base layer 50.

The sizing member 100 is preferably manufactured in which the front cover 106 and rear cover 110 includes a material such as, non-woven polyester or synthetic leather. The front cover 106 and rear cover 110 are attached to one another or fastened around the periphery of the sizing member 100 with a fastening member 120 such as, adhesive bonding or stitching. If desired, the front 106 and rear 110 covers may be made from the same material. The center core 116 is preferably composed of resilient high-density foam, such as polyurethane or a similar material. This composition advantageously provides for the sizing member 100 to generally conform to the heel 40 of the wearer. In a preferred embodiment, the thickness of the sizing member 100 is approximately 10.0 mm, however, may range between 3.2 mm to 10 mm (0.125 to 0.40 inches). The front cover 106 preferably has a 1.1 mm thickness and the rear cover 110 has a 0.8 mm thickness. The center core 116 thickness may range between 6.0 to 8.0 mm.

Figure 15:
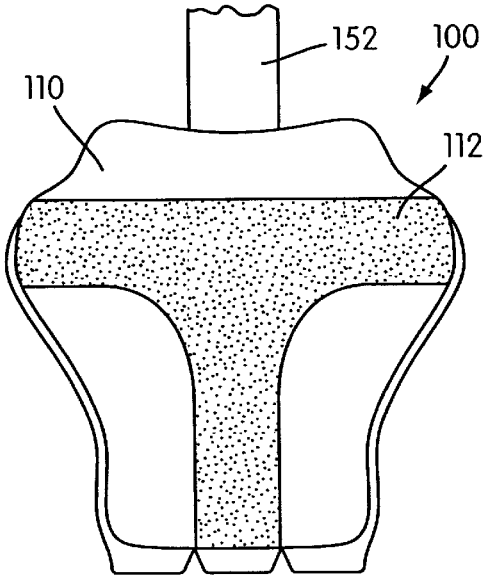
FIG. 15 is a rear view of the sizing member of FIG. 14.
Figure 17:
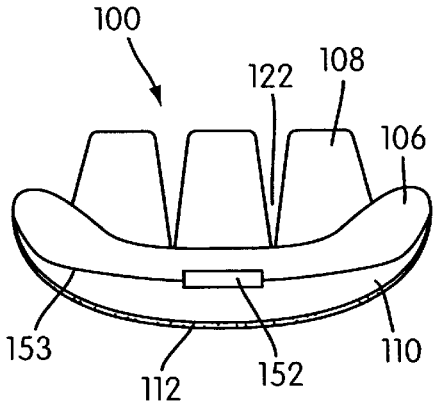
FIG. 17 is a top plan view of the sizing member of FIG. 14.

An alternative sizing member 100 having a flaccid strap 152 is shown in FIGS. 14–17. The sizing member 100 and FIGS. 14–17 differs from the sizing member of FIGS. 2–3 primarily in its use of a strap 152 instead of a strip of material 150 and in its shape in conforming to the inside heel portion of shoe 20. The strap 152 is preferably made from a woven material, but any type of flexible strap material may be used. The strap 152 may be attached to the sizing member 100 by being sewn and such may be accomplished by inserting the strap 152 between the front and rear covers 106 and 110 so that the strap 152 is sewn together with the covers 106 and 110. As seen in FIG. 15, the part of the fastening system 112 on the rear cover 110 may be in shape of a "T" to provide a stronger holding force with the rear of the shoe adjacent the top of the sizing member 100.

Figure 10:
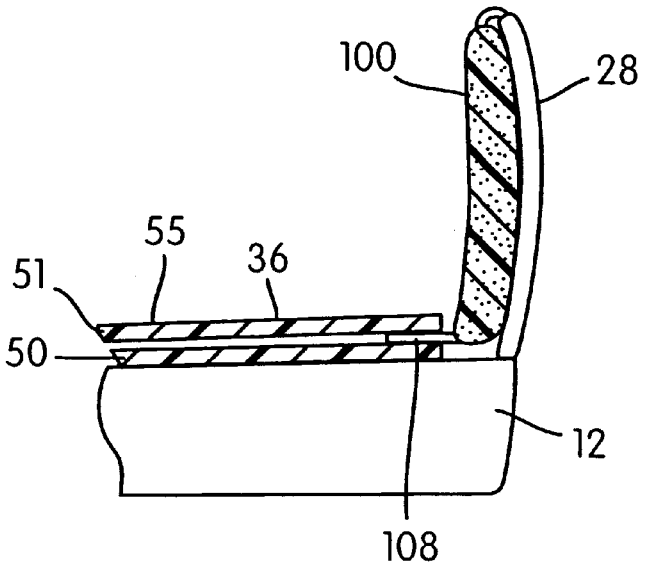
FIG. 10 is a side view of one arrangement of a connection between a flap portion of the sizing member and sockliner.
Figure 11:
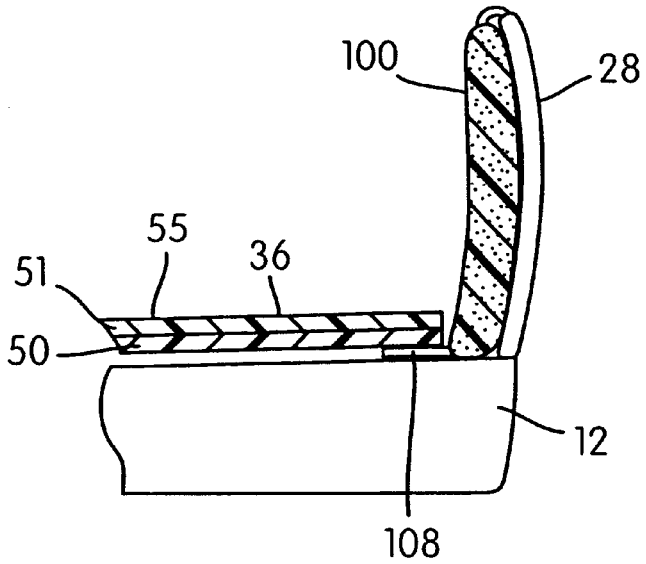
FIG. 11 is a side view of another arrangement of a connection between the flap portion of the sizing member and a sockliner.
Figure 13:
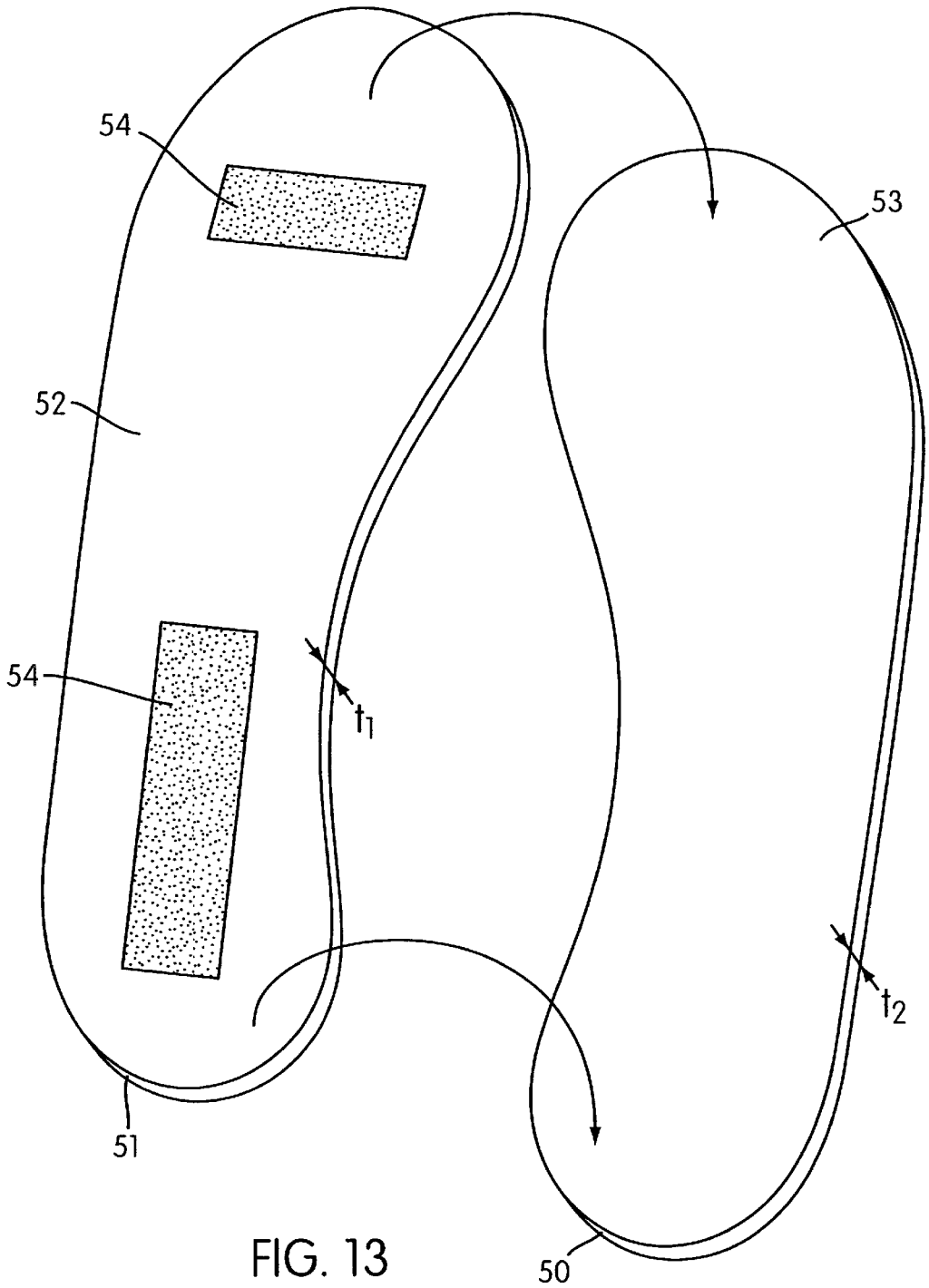
FIG. 13 is a schematic view showing the multilayered sockliner.
Figure 14:
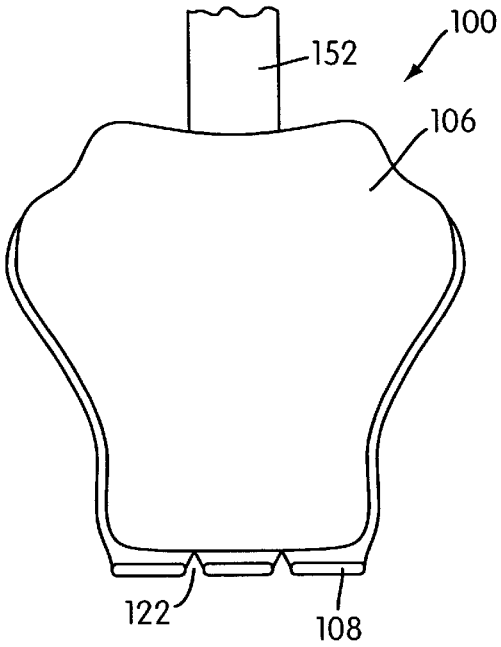
FIG. 14 is a front view of an alternative embodiment of a sizing member.
Figure 16:
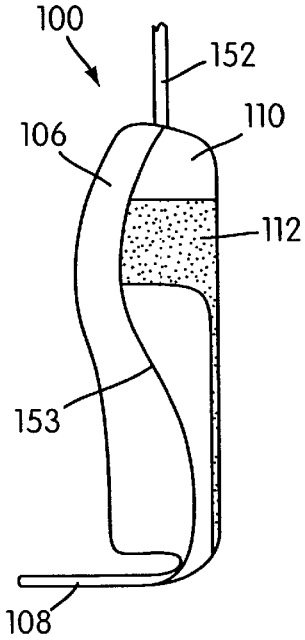
FIG. 16 is a side elevational view of the sizing member of FIG. 14.

FIGS. 4, 10, and 13 illustrate a sockliner 36 having a plurality of separable layers 50 and 51 that may be included with the athletic shoe 20 and the sizing member 100. In such a separable sockliner system, the sockliner 36 includes a base layer 50 having a thickness $t_1$ and one or more than one separable upper removable layers 51. In this example, one sockliner layer 51 is depicted and has a thickness of $t_2$. In this embodiment, the sizing member 100 and the sockliner 36 operate in conjunction forming a sizing system to provide multidimensional adjustability using the effective length and effective height effective width of the athletic shoe 20. If desired, either one or both of the sizing member 100 and the sockliner 36 can further provide the sizing system to provide adjustability using the effective width of the athletic shoe 20.

To prevent the sockliner layers 50 and 51 from moving or shifting with respect to each other when the shoe is being worn or fitted, a fastening system may be employed between the layers 50 and 51. This fastening system provides a holding force between the layers 50 and 51 when both sockliner layers 50 and 51 are being used and also allows the upper layer 51 to be separable or releasable from the lower or base layer 50 when desired by the wearer. This is accomplished by placing a releasing force on the sizing member 100 of sufficient magnitude to break an adhesive or a mechanical bond. The fastening system 112 is used as an aid to prevent movement or shifting of the sizing member 100 when the shoe is worn by the wearer.

In one preferred arrangement, the fastening system preferably includes a mechanical locking system, for example a hook and loop closure system that may include strips of interlocking materials where one strip would include hooks and the other would include loops. Suitable systems are commercially available such as VELCRO®. Preferably, the fastening system may includes hooks 54 at some location on the bottom surface 52 of the upper sockliner layer 51. A woven or other similar material having interstices between its fibers is provided on the upper surface 53 of the lower or base layer 50. In effect, the interstices between the fibers of the material on the upper surface 53 of the lower sockliner layer 50 act as loops and lockingly receive the hooks 54 on the bottom surface 52 of the upper sockliner layer 51. This provides a holding force between the sockliner layers 50 and 51 and prevents the layers 50 and 51 from shifting in the shoe 20 when worn or being fitted. Another alternative for the fastening system is the use of a tacky releasable adhesive. The lower surface of the base sockliner layer 50 may be fixed to the upper layer of the sole.

According to the present invention, when the foot 42 of the wearer becomes tightly fitting against the upper 10, an upper layer 51 of the sockliner 36 may be separated from the base layer 50 and removed from the shoe to provide the wearer of the shoe 20 increased effective height. By removing layer 51, the difference of effective height is created as the footbed 35 is lowered from the upper surface of layer 51 and the upper surface of base layer 50 by the distance equal to the thickness $t_2$ of the removed layer 51.

In one preferred embodiment, both sockliner layers 50 and 51 are substantially flat. However, if desired, at least the upper sockliner layer 51 may be shaped to wrap up along the side walls of the upper at its lateral and/or medial sides to enable the effective width of the shoe 20 to be modified by the sockliner system. This can occur in the forefoot and/or rearfoot locations of the shoe 20. Thus, by the removal of the upper sockliner layer 51, the effective width can be increased.

Further it is recognized that while the adjustable length system with sizing member 100 and the adjustable height system with the multilayer sockliner 36 are preferably used together, the sizing member 100 may be used with any appropriate sockliner 36 and is not limited to use with an adjustable sockliner system. Similarly, it is recognized that the adjustable sockliner system can be used to provide adjustable height without the use of a sizing member 100.

Figure 8:
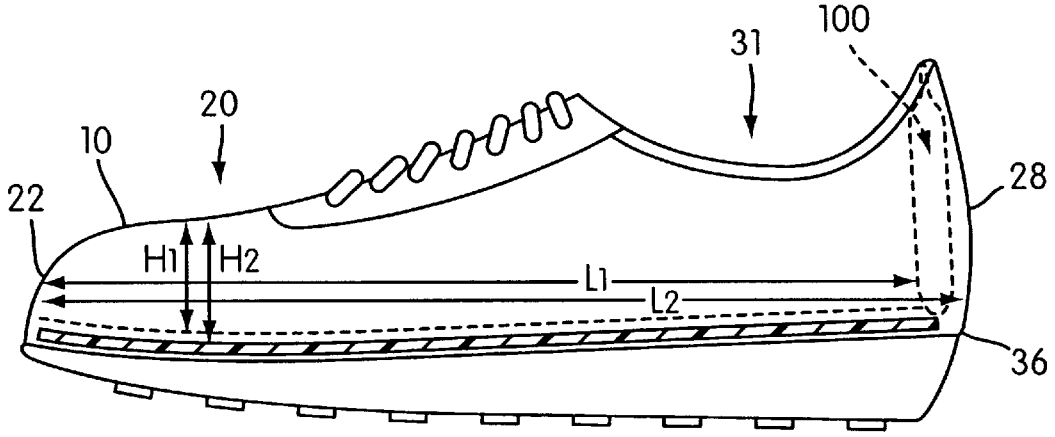
FIG. 8 is side elevational view the an article of footwear illustrating an effective length and an effective height.
Figure 9:
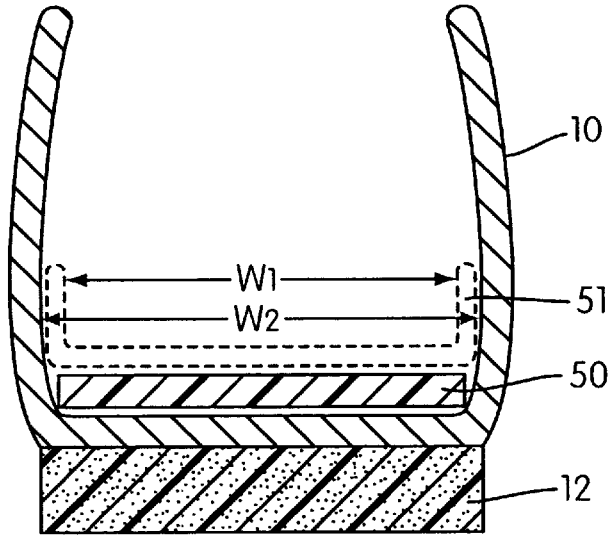
FIG. 9 is a sectional view taken along line 9—9 of FIG. 4.

Referring to FIGS. 8 and 9, the effective length (L) of the shoe 20 is generally measured from the inner wall of the heel section 28 to the inner wall of the forefoot section 22 at the toe. As shown in FIG. 8, the removal or alternate positioning of the sizing member 100 increases the effective length of the shoe 20 from $L_1$ to $L_2$. The effective height (H) of the shoe 20 is generally defined as the vertical distance between the footbed 35 (or upper surface) of the sockliner 36 and interior of the upper 10 at a predetermined point. The difference between the effective height at any one position may vary as the height of the sockliner 36 is varied such that changing the thickness of the sockliner 36 has a direct correlation to creating a difference in the effective height. As shown in FIG. 8, the removal of an upper sockliner layer 51 from the shoe 20 increases the effective height of the shoe 20 from $H_1$ to $H_2$. As shown in FIG. 9, if the upper sockliner layer 51 is of the type that wraps up on one or more of its sides, the effective width (W) of the shoe 20, which is defined as the distance between the inside portions of the medial and lateral sides of the shoe 20 where the foot is cradled, is increased from $W_1$ to $W_2$ when the upper sockliner layer 51 is removed. Similarly, if the sizing member 100 wraps around the heel to extend at least partially along the medial or lateral side of the foot 42, removal or alternate positioning of the sizing member 100 will increase the effective width of the shoe 20 in the rearfoot region.

The operation of the present invention having a sizing member 100 and multiple sockliner layers 50 and 51 will now be described with one of ordinary skill in the art recognizing that these adjustable features need not be required to be used together. The shoe 20 is typically offered for sale and purchased with the sizing member 100 in an "in use" position or engaged mode and the multiple sockliner 36 having multiple layers 50 and 51 are preferably disposed in the shoe 20 so that the footbed 35 is formed by the upper surface 55 of the upper sockliner layer 51. It is this sizing upon which the user will typically fit for comfort and wear purposes.

In the "in use" position, the sizing member 100 extends into the interior of the shoe 20 and moves spatially into the internal heel section 34, and creates a first effective length ($L_1$). The sizing member 100 is retained within the internal heel section 34 by a mating arrangement as previously described, such as an adhesive or the hooks on rear cover 110 and inherent or added loop structure on the inner surface 33. Typically, all layers 50 and 51 of the sockliner 36 will also be in the shoe 20 with the upper surface 55 of the upper sockliner layer 51 forming the footbed 35 and providing the shoe 20 with a first effective girth or height ($H_1$). The flap 108 is preferably disposed horizontally and disposed in a position beneath the wearer's foot 42, and more preferably beneath at least one sockliner layer. The sizing member 100 is preferably retained in the engaged mode while foot 42 of the wearer is growing. When worn, it is further locked in place by flap 108 disposed beneath the weight provided by the wearer's foot 42.

Figure 7:
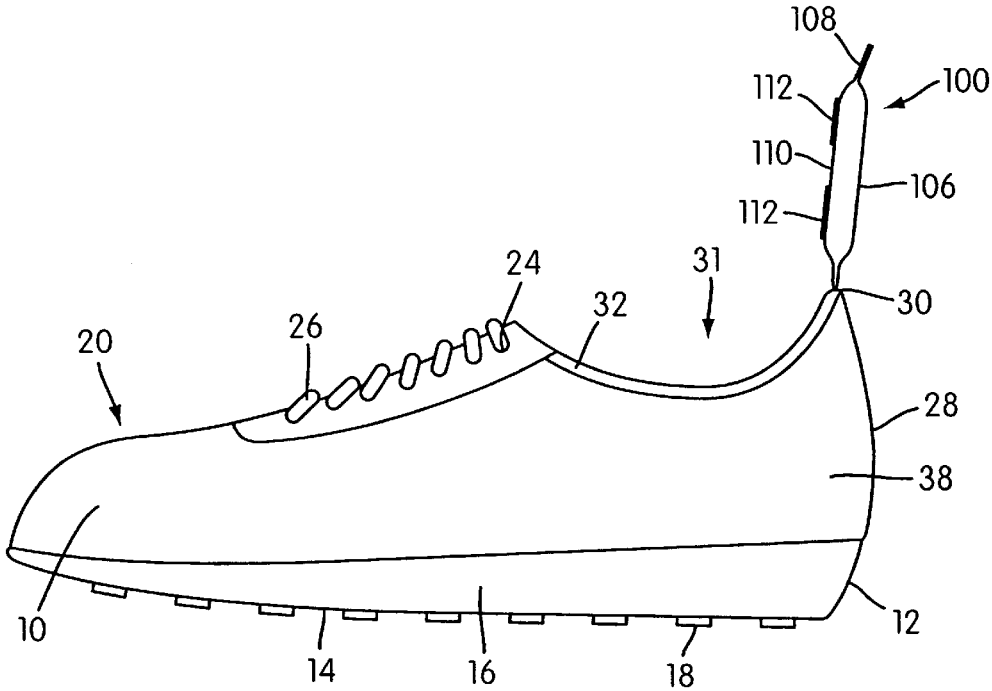
FIG. 7 is a side elevational view of the athletic shoe similar to FIG. 4 showing the sizing member 100 in an intermediate or non-engaged position.

The user will continue to wear the shoe 20 under these conditions while his or her foot 42 grows. After the user's foot grows by a predetermined size, the shoe 20 becomes tight fitting and signals the wearer to adjust the sizing of the shoe 20 to gain another wearable size without sacrificing a proper fit within normal ranges. To accomplish this, the sizing member 100 can be removed or alternately positioned and the upper sockliner layer 51 can be removed. First, the user can disengage the sizing member 100 from the heel section 28 by grasping the lateral side 102 and/or medial side 104 of the sizing member 100 and pulling the sizing member 100 away from the inner surface 33. This creates a force that releases the sizing member 100 from the mechanical or adhesive bond of the fastening system 112. The sizing member 100 can thereby be placed in an intermediate or disengaged position and moved outside of the foot opening 31 as shown in FIG. 7. In this position, the sizing member 100 can be separated from the shoe 20 by applying opposing pulling forces on opposite sides of separation line 118. Alternatively, the strip of material 150 or strap 152 may be cut by a cutting tool such as a scissors to separate the sizing member 100 from the shoe 20. In another variation, the sizing member 100 may be moved outside of the foot opening and attached to the outside of the upper 10 as shown in FIG. 12. When the sizing member 100 is disengaged, a second effective length is formed and the shoe 20 is usable up to the incremental increase in effective length of the shoe 20 or the difference in length between $L_2$ and $L_1$.

For the multilayer sockliner 36, the upper sockliner layer 51 may be lifted upwardly from the lower or base sockliner layer 50. This force will release the fastening system therebetween and the upper sockliner layer 51 may be removed from the foot opening 31. This will increase the effective height of the shoe 20 from $H_1$ to $H_2$ and will lower the footbed 35 from the upper surface 55 of the upper sockliner 551 to the upper surface 52 of lower sockliner layer 50.

If the flap 108 is fixedly attached to the upper sockliner layer 50, a force applied by the user on sizing member 100 will not only provide a force to separate the sizing member 100 from the inner surface 33 of the heel region, but it will also supply a releasing force on the fastening system between the sockliner layers 50 and 51, and will therefore assist in the removal of the upper sockliner layer 51 from the shoe 20.

Further, if the sizing member 100 wraps around the heel and extends at least partly along the side of the wearer's foot, or if the upper sockliner layer 51 wraps upwardly on one or more sides of the wearer's foot, the removal of the element (s) increases the effective width of the shoe 20. For example, as shown in FIG. 9, the removal of the upper sockliner layer 51 will increase the effective width from $W_1$ to $W_2$.

Thus, this system advantageously extends or increases the useful life of the shoe 20 for the particular wearer. This allows the wearer to continue using the shoe 20 for an additional portion of an athletic season or a full season depending on the pace the grow of the foot 40 of the wearer.

The shoe 20 may be designated for sale by the manufacturer by either its smaller or its larger effective length. Under one system, the designation correlates to the smaller effective length, that is the size of the shoe 20 with the sizing member 100 engaged. For example, if the wearer initially had a foot size of 5½, he or she would likely purchase a size 5½. In a preferred embodiment, the sizing member 100 has a thickness to affect the effective length of the shoe 20 to the next adjacent commonly sold and/or marketed size. Thus, the sizing member 100 will typically have a thickness to change the effective length of the shoe 20 by substantially a half-size under the American standard sizing system. Therefore, in the engaged mode, the shoe will fit the size 5½ foot 42 properly. As the foot 42 grows beyond a size 5½ and approaches a size 6, the shoe 20 will become tight fitting and the toes of the wearer will eventually contact or substantially contact the front of the upper 10 making the shoe 20 uncomfortable. The wearer or other person associated with the wearer preferably invokes the disengaged mode of the sizing member 100 by positioning the member 100 outside of the opening 31 or if desired, detaches it from the shoe 20. The removal of the sizing member 100 advantageously transforms or modifies the shoe 20 designated as a size 5½ into a size 6 (based on the effective length). In addition, in the case of a multilayer sockliner 50, 51, the removal of layer 51 modifies the effective height of the interior of shoe 20. In addition, the removal of layer 51 (the second position of the multilayer sockliner 50, 51) creates a differential increase in the effective width of the shoe 20. In a preferred embodiment, the sizing member 100 may advantageously allow the shoe 20 to be usable up to one additional athletic season. Thus, the useful life of the shoe 20 is extended beyond the conventional half-size or equivalently sized athletic shoe or other article of footwear. Alternatively, the sizing member 100 may modify the effective length by less than a half-size to create a better fit within a half-size range. In a preferred embodiment under other shoe sizing denominations, it is also preferred to have the removal of the sizing member 100 increase the effective length of the shoe 20 by an amount sufficient to go from one commonly sold size to the next.

It is also recognized that one of the sizing member 100 and upper sockliner layer 51 may be removed without the other. This is advantageous in that it provides additional fitting sizes for people having foot proportions that deviate a significant amount from the norm. For example, typical girth to width relationships for average foot sizes may be $H_1$:$L_1$ and $H_2$:$L_2$. However, if a user has a foot with a girth to length ratio that is substantially larger than the norm, such as $H_2$:$L_1$, he or she may be normally required to buy special or customized shoes to obtain a proper fit. However, with the present invention, a perfect fit may be obtained as the removal of the upper sockliner layer 51 and the retention of the sizing member 100, will provide a comfortable fit by yielding an effective height of $H_2$ and an effective length of $L_1$. Further, if a user has a foot with a girth to length ratio that is substantially larger than the norm, such as $H_1$:$L_2$, he or she may be normally required to buy special or customized shoes to obtain a proper fit. However, with the present invention, a perfect fit may be obtained as the retention of the upper sockliner layer 51 and the removal of the sizing member 100, will provide a comfortable fit by yielding an effective height of $H_1$ and an effective length of $L_2$.

Referring to FIGS. 1, 4, 6, and 7, the upper 10 of the athletic shoe 20 is made of a desirable material or a combination of materials thereof such as, split-leather, full-grain leather, suede, polyester, nylon, or a breathable mesh. The collar 32 and ankle collar 30 is preferably be composed a cloth fabric or other materials intended for use as collars. The surface 33 of the internal heel area 34 preferably includes any desirable lining material. The material for the surface 33 cooperates with the fastening system 112 on the inner lining 110 of the sizing member 100. In a preferred embodiment, the lining material is woven such that it will simulate loops to cooperate with the hook closures located on inner lining 110. The sockliner 36 is preferably composed of polyester ethyl vinyl acetate ("PEEVA") material having a thickness of 4.0 mm. The upper surface or footbed 35 of sockliner 36 is generally composed of a knit fabric mounted or bounded to the PEEVA material. The sizing unit 60 may formed with a molding process. The separation line 118 may be formed any conventional manufacturing tooling that will deform the material to reduce the strength in the modified area.

While these particular embodiments of the invention has been shown and described, it is recognized the various modifications thereof will occur to those skilled in the art. Therefore, the scope of the herein-described invention shall be limited solely by the claims appended hereto.

What is claimed is:

1. An article of footwear, comprising:

a sole;

an upper extending from the sole, the upper having a front portion, a rear portion, a foot opening at the rear portion positioned to receive a foot when worn, and an inner heel portion positioned at the rear portion inside of the foot opening; and a sizing member attached to the upper and selectively positionable between a first position within the foot opening at the inner heel portion so as to form a first predetermined foot size of said article of footwear and a second position located outside of the foot opening so as to form a second predetermined foot size of said article of footwear;

wherein said sizing member includes a preformed weakened separation line, said preformed separation line configured for assisting a user to separate said sizing member from said upper along the preformed separation line.

2. The article of footwear of claim 1, wherein the sizing member is removably attached to the upper at the preformed separation line.

3. The article of footwear of claim 1, wherein said sizing member includes an attachment member having a first end and an opposing second end, said first end of said attachment member being attached to said sizing member and said second end of said attachment member being attached to said rear portion of said upper, said preformed separation line being disposed between said first end and said second end of said attachment member.

4. The article of footwear of claim 3, wherein the preformed separation line includes a plurality of perforations.

5. The article of footwear of claim 3, wherein the preformed separation line includes a deformed portion that includes a sufficiently low breaking strength to enable said sizing member to be separated from said upper by a tensile force applied to said preformed separation line.

6. The article of footwear of claim 3, wherein the attachment member has opposing sides, said preformed separation line is curved between its opposing sides.

7. The article of footwear of the claim 1, wherein a bottom end of the sizing member includes an extension portion extending substantially horizontally therefrom and covering a region superimposed below the foot opening when the sizing member is in the first position.

8. The article of footwear of claim 7, further comprising a sockliner, wherein the extension portion of the sizing member is positioned between a sockliner and the sole.

9. The article of footwear of claim 7, further comprising a sockliner having multiple layers, wherein the extension portion extends between at least two layers of the sockliner.

10. The article of footwear of claim 1, further comprising a fastening system adapted to secure the sizing member to said inner heel portion of the upper.

11. The article of footwear of claim 10, wherein the fastening system includes at least one of a releasable adhesive and a plurality of hooks.

12. The article of footwear of claim 10, wherein said sizing member includes a predetermined thickness so that the difference between the first predetermined foot size of said article of footwear and the second predetermined foot size of said article of footwear is substantially equal to a one-half foot size.

13. The article of footwear of claim 1, wherein the sizing member includes an inner core of a compressible material.

14. The article of footwear of claim 13, wherein the sizing member includes a substantially air tight enclosure, said inner core being disposed within said enclosure.

15. The article of footwear of claim 1, further comprising a sockliner having at least first and second sockliner layers, wherein said first and second sockliner layers are releasably attached to one another, wherein a lower end of said sizing member includes a flexible extension member extending substantially horizontally therefrom and said flexible extension member is configured to be disposed underneath said sockliner when the sizing member is in said first position.

16. An article of footwear, comprising:

a sole;

an upper attached to and extending outwardly from the sole, the upper having a front portion and a rear portion, the upper having a foot opening at the rear portion positioned to receive a foot when worn, and the upper having an inner heel region adjacent to said foot opening;

a sockliner, said sockliner having an upper surface defining a footbed; and a sizing member having an top portion and a bottom portion, the top portion removably attached to the upper adjacent the foot opening, the bottom portion having an extension, said extension extending below the footbed, wherein the article of footwear has a first effective length when the sizing member is positioned within the foot opening at the inner heel region and second effective length when the sizing member is positioned outside of the foot opening; wherein the sizing member has a predetermined thickness such that the difference of effective length between the first effective length and the second effective length substantially equals one-half shoe size.

17. The article of footwear of claim 16, wherein said sockliner has a base layer and an upper layer contacting the base layer.

18. The article of footwear of claim 17, wherein the extension of the sizing member is disposed between the base and upper layers of the sockliner.

19. The article of footwear of claim 17, wherein the extension is fixedly attached to the upper layer of the sockliner.

20. The article of footwear of claim 16, wherein said sizing member includes a preformed separation region disposed in said top portion so that said sizing member is removable from said upper at said preformed separation region.

21. The article of footwear of claim 20, wherein the sockliner includes a fastening system for removably coupling said base layer and said upper layer.

22. The article of footwear of claim 20, further comprising a strap having first and second ends, said first end of the strap being attached to said the sizing member and said second end of the strap being attached to said upper, wherein said preformed separation region is disposed between said first end and said second end of said strap.

23. The article of footwear of claim 22, wherein said upper includes an outside surface opposite of said inner heel region, said second end of said strap is attached to said outside surface of said rear portion of said upper.

24. The article of footwear of claim 16, wherein the sizing member includes an inner core of a compressible material and an enclosure, said inner core being disposed within said enclosure.

25. An article of footwear having an adjustable shoe sizing system, a sole, an upper extending from the sole, and a foot opening positioned to receive a foot when worn, said adjustable shoe sizing system, comprising:

a first member, said first member removably coupled within the upper; and a second member, said second member removably coupled within the upper;

wherein the first member is a sizing member removably coupled to a heel portion of the upper adjacent the foot opening enabling a user to adjust an effective length of the article of footwear by one-half size, and wherein the article of footwear further includes a sockliner having a plurality of separable layers, wherein said second member is a sockliner layer removably coupled to another sockliner layer for enabling a user to adjust an effective height of the article of footwear.

26. The article of footwear of claim 25, wherein the sizing member includes a flap extending from a bottom portion of the sizing member such that the flap is disposed beneath at least one sockliner layer.

27. The article of footwear of claim 25, wherein the sizing member includes a preformed weakened separation line at the top portion to allow the sizing member to be detached from the upper.

28. The article of footwear in accordance with claim 27, wherein said preformed separation line includes at least one of a plurality of perforations and a groove.

29. An article of footwear, comprising:

a sole;

an upper extending from the sole, the upper having a front portion, a rear portion, a foot opening at the rear portion positioned to receive a foot when worn, and an inner heel portion positioned at the rear portion inside of the foot opening; and a sizing member attached to the upper and selectively positionable between a first position within the foot opening at the inner heel portion so as to form a first predetermined shoe size of said article of footwear and a second position located outside of the foot opening so as to form a second predetermined shoe size of said article of footwear, said sizing member being removably coupled to the rear portion of the upper;

wherein the sizing member has a predetermined thickness configured to selectively alter an effective length of the upper by a fixed amount substantially equal to a one-half shoe size between said first position and said second position wherein said sizing member includes a preformed separation region being weakened, said preformed separation region configured for allowing a wearer to separate said sizing member from said upper along the preformed separation line.

30. The article of footwear in accordance with claim 29, wherein the sizing member includes a top portion having a first end and a second end, said first end of said top portion being attached to said sizing member and said second end of said top portion being fixedly attached to said rear portion of said upper, said preformed separation region being disposed between said first end and said second end of said top portion.

31. The article of footwear in accordance with claim 30, wherein the preformed separation region includes at least one of a plurality of perforations, and a grooved depression.

32. The article of footwear in accordance with claim 30, wherein said top portion is an elongated flexible strap.

* * * * *